US005422235A

United States Patent [19]

Chapman et al.

[11] Patent Number: 5,422,235

[45] Date of Patent: Jun. 6, 1995

[54] PROCESS FOR MANUFACTURING PHOTOGRAPHIC PAPER

[75] Inventors: John W. Chapman, St. Andrews; Andrew F. Sierakowski, Brunswick; Robyn A. Whittle, East Brighton, all of Australia

[73] Assignee: Eastman Kodak Company, Rochester, N.Y.

[21] Appl. No.: 107,654

[22] PCT Filed: Dec. 18, 1992

[86] PCT No.: PCT/AU92/00672

§ 371 Date: Aug. 17, 1993

§ 102(e) Date: Aug. 17, 1993

[87] PCT Pub. No.: WO93/12461

PCT Pub. Date: Jun. 24, 1993

[30] Foreign Application Priority Data

Dec. 19, 1991 [AU] Australia ..... PL0090

[51] Int. Cl.[6] ..... G03C 1/775

[52] U.S. Cl. ..... 430/538; 430/621; 430/536; 430/349; 430/935; 162/135; 162/136

[58] Field of Search ..... 430/538, 621, 536, 349, 430/935; 162/135, 136

[56] References Cited

U.S. PATENT DOCUMENTS

| | | | |
|---|---|---|---|
| 2,620,285 | 7/1951 | Rose | 430/538 |
| 2,725,305 | 11/1955 | Allen et al. | 430/538 |
| 3,782,955 | 1/1974 | Mucke et al. | 430/351 |
| 3,806,574 | 4/1974 | Arvidson, Jr. | 264/160 |
| 4,149,322 | 4/1979 | Minoda et al. | 34/4 |
| 4,154,612 | 5/1979 | Minoda et al. | 430/496 |
| 4,272,616 | 6/1981 | Kishimoto | 430/529 |
| 4,399,214 | 8/1983 | Lohmer | 430/532 |
| 4,933,267 | 6/1990 | Ishigaki et al. | 430/349 |

FOREIGN PATENT DOCUMENTS

| | | |
|---|---|---|
| 0317247 | 11/1988 | European Pat. Off. . |
| 56-005542 | 4/1981 | Japan . |
| 53-30656A | 10/1984 | Japan . |
| 62-81636 | 4/1987 | Japan . |
| 62-81637 | 4/1987 | Japan . |
| 62-280835 | 12/1987 | Japan . |
| 0026654 | 2/1988 | Japan . |
| 1-129245 | 5/1989 | Japan . |
| 1-180278 | 7/1989 | Japan . |
| 63-270116 | 4/1990 | Japan . |

*Primary Examiner*—Thomas R. Neville
*Attorney, Agent, or Firm*—Charles E. Snee, III

[57] ABSTRACT

In a photographic paper production method, a photographic paper support is coated with one or more photographic silver halide emulsion layers and one or more other hydrophilic colloid layers, at least one of the layers including a hardener. The coated support is then dried and conditioned to a temperature of from 24° C. to 33° C. The photographic and other layers on the support are conditioned to an equilibrium relative humidity of from 55% to 70%. The coated support is then stored at the conditioned temperature until the photographic and other layers have achieved a predetermined hardness. The new photographic paper production method reduces the post-production storage time required for photographic paper to achieve an acceptable level of abrasion resistance.

12 Claims, 2 Drawing Sheets

Figure 1:
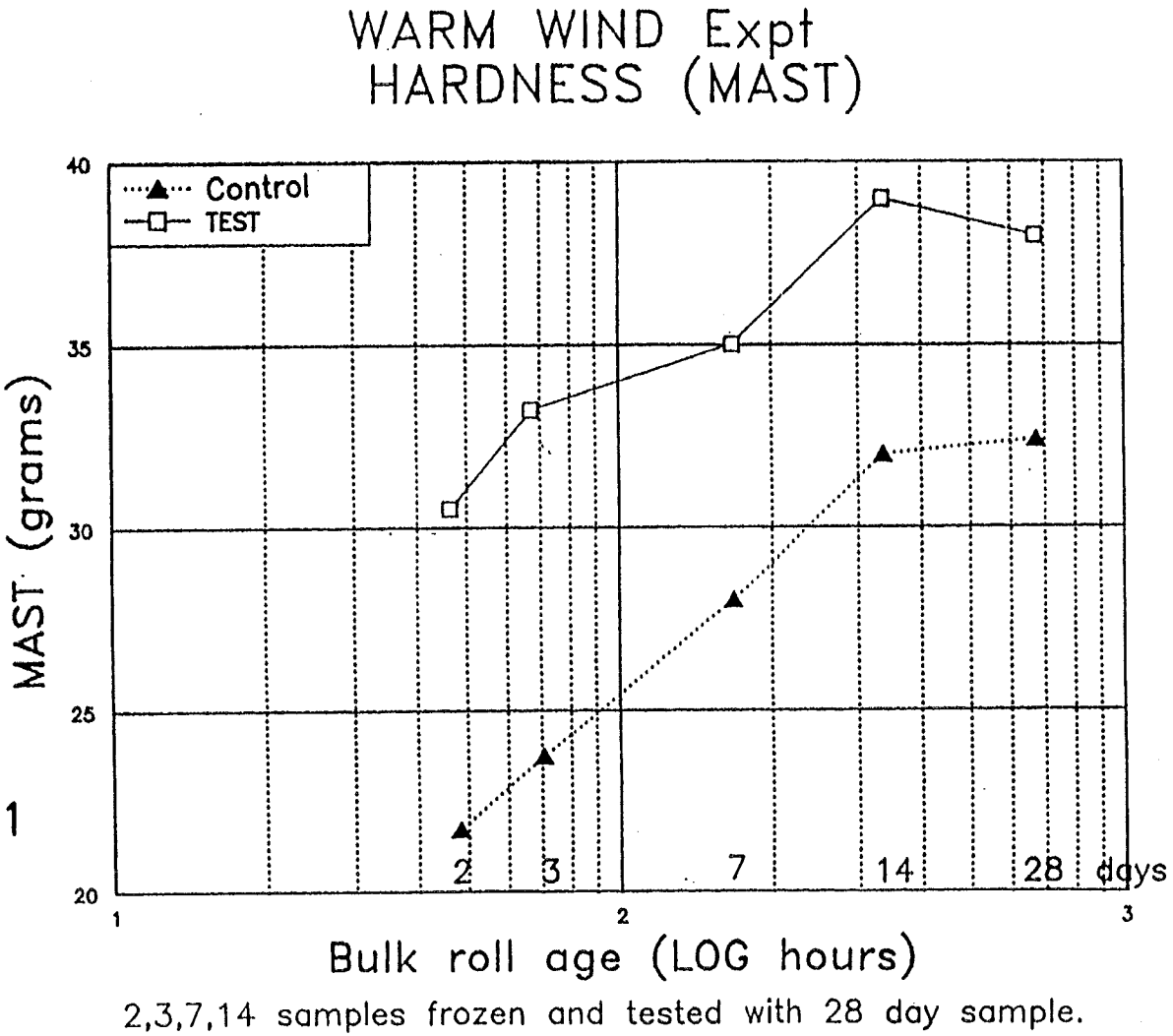

2,3,7,14 samples frozen and tested with 28 day sample.

2,3,7,14 samples frozen and tested with 28 day sample.

PROCESS FOR MANUFACTURING PHOTOGRAPHIC PAPER

This invention relates to a process for manufacturing photographic paper. It relates particularly to a process for conditioning photographic paper during and after the drying process.

Photographic papers are normally produced by coating a polyethylene resin coated paper support with various photographic layers such as silver halide emulsion layers, and with a colloid such as gelatin dispersed throughout the photographic layers. However, because swollen gelatin layers exhibit a low degree of abrasion resistance, it is normally necessary to improve the strength of the colloid layers by adding a hardener. This process is well known in the photographic industry, and numerous different varieties of hardeners are known. Vinyl sulfone-type hardeners are described for example in U.S. Pat. No. 3,481,872 and U.S. Pat. No. 3,642,486.

Photographic paper supports are conventionally produced in substantial lengths. In a normal manufacturing process, the paper is coated with photographic and other layers, and it is then dried before being wound up as a roll for storage.

In order to achieve a satisfactory hardness within the colloid dispersed throughout the photographic layers on the support, a sufficient period of time must be allowed for the cross-linking reaction brought about by the hardener to occur. Under normal manufacturing conditions it is therefore necessary to store a roll of paper for a period of time (typically a number of weeks) after the coating and drying process, to ensure that a sufficient hardness is achieved. However, storage constraints of this kind impose considerable costs on the manufacturing operation, and there is therefore a need for a method of accelerating the hardening reaction.

It has variously been suggested that significant increases in hardness can be obtained from short exposures to extreme temperatures. The reason for this is thought to be that more opportunities for cross-linking between gelatin and hardener molecules occur when the gelatin is in a mobile state, and mobility is increased with temperature. However, elevated temperatures may have adverse effects on the photographic coatings in the photographic paper. Moreover, when a roll of paper is cooled from an elevated temperature, the external portions of the roll cool more rapidly than the internal portions, and this can result in non-uniform hardness and sensitometric properties throughout the roll.

It has also been suggested that humidity levels in the photographic coatings may be relevant to the hardening process, but such suggestions have not achieved widespread acceptance.

According to the present invention there is provided a photographic paper production method comprising the steps of:

(a) coating a photographic paper support with one or more photographic silver halide emulsion layers and one or-more other hydrophilic colloid layers, at least one of said layers including a hardener;

(b) drying the coated support;

(c) conditioning the coated support to a temperature of from 24° C. to 33° C. and conditioning the photographic and other layers on the support to an equilibrium relative humidity (ERH) of from 55% to 70%; and (d) storing the coated support substantially at the conditioned temperature until the photographic and other layers have achieved a MAST hardness (as hereinafter defined) of 25 grams or more.

When the method of the present invention is used in the production of a roll of photographic paper, the step of winding the support occurs directly after step (c), so that the temperature and ERH conditions are preserved. It is not necessary that the ERH conditions of the photographic and other layers be monitored or held constant after winding, but it is preferred that the coated support be stored within a moisture-proof casing or material.

Experimentation has confirmed that an increase in humidity leads to acceleration of the hardening reaction. More importantly and surprisingly, experimentation has revealed that considerable acceleration of the hardening reaction can be achieved with only a slight increase in temperature over representative prior art conditions, if humidity is increased. When humidification is provided in the photographic layers as described in step (c) above, the photographic layers are at favourable conditions for the hardening reaction to proceed. In order to assist this effect, it is preferred that the water content of the paper support be between 7 and 8 weight per cent, and more preferably between 7.5 and 8 weight per cent, thus providing an ERH in the support of approximately 53%.

A redistribution of water occurs between the photographic layers and the support over a period of time, typically less , than 24 hours, returning the emulsion ERH to a condition very close to that of the support therefore not affecting the long-term keeping properties of the emulsion or the mechanical properties of the support. The redistribution of water between the photographic layers and the paper support results in a reduction of the conditioned ERH of the photographic layers, but the present invention allows for variation in the ERH of the photographic layers during storage step (d). The length of time over which the water redistribution occurs depends to some extent on the nature of the paper support. For this reason, it is preferred that the paper support be pre-coated with a resin such as a polyethylene resin, which delays the water redistribution. It has further been found that the photographic paper will not become sticky and hence difficult to unwind if emulsion ERH is below 70% over this temperature range.

Experimentation has also confirmed that it is important to maintain the temperature of the photographic paper at a substantially constant level throughout the storage period because an increase or decrease in the storage temperature results in uneven distribution of temperature throughout the roll, and this in turn results in unequal hardening of the photographic paper and non-uniform photographic effects throughout the roll.

The colloid and the hardener used in the method of the present invention may be any suitable substances. Although it is known-that the hardening reaction occurs at different rates for different combinations of hardeners and colloids, the present invention is not restricted to particular combinations. It is however preferred that the hardener be of the vinyl sulfone type according to the general formula:

$$CH_2{=}CHSO_2{-}R{-}SO_2CH{=}CH_2$$

wherein R represents a divalent connecting group, an alkylene group, or a substituted alkylene group. Favourable results are achieved if the winding and storage temperatures are approximately 26° C. and the winding ERH of the photographic layers is approximately 63%. In these conditions, a desired degree of hardness can be achieved after a surprisingly short time of about two days. The unexpected effectiveness of the combination of conditions means that it is possible to achieve considerably shortened storage times in an environment which is comfortable for operators and not overly expensive to maintain.

When higher temperatures are used during conditioning step (c) and storage step (d), the desired degree of hardness can be achieved after about ½ day. However, when temperatures above about 33° C. are used, sensitometric changes are accelerated and the storage time must be reduced in order to preserve the shelf-life of the product. If, on the other hand, a conditioning temperature above about 33° C. is used in step (c), but the coated support is stored at lower temperatures, temperature differences between inner and outer parts of the roll on cooling may result in sensitometric and hardness variability in the finished product.

The invention will hereinafter be described in greater detail by reference to an example which illustrates particular embodiments of the invention. It is to be understood that the particularity of the example does not supersede the generality of the preceding description of the invention.

EXAMPLE

In order to demonstrate the invention, various rolls of photographic paper were manufactured and tested.

The paper support was coated on both sides with a polyethylene resin provided with glossy texture. The polyethylene coating on the face side of the paper was in the range 24.9 to 29.8 grams per square meter, and the back side polyethylene coating was in the range 26.8 to 31.7 gsm. The overall paper thickness was 210 to 230 micron. The water content was 7.5 to 8 weight per cent.

The test photographic paper rolls were coated and dried according to conventional techniques. The hardener used was a hardener of the vinyl sulfone type. The hardener-to-gelatin level was in the range 1.5 to 2% by weight. Immediately before winding, the rolls were conditioned to a temperature of 26.5° C., and the photographic layers on the paper supports were conditioned to an ERH of 63%.

The polyethylene resin coating on the paper support served to retard redistribution of humidity between the photographic layers and the support, so that favourable conditions for hardening (high ERH in photographic layers) remained for a period of up to 24 hours.

Various control photographic paper rolls were also manufactured. For the purposes of the present example and to illustrate typical prior art conditions, the control conditions selected were a conditioning and winding temperature of 22° C. and an emulsion ERH of 52%.

The test rolls were stored in a moisture-proof environment at a controlled temperature of 25° C., which is substantially the temperature during conditioning.

The hardness of the test samples was measured at 2, 3, 7, 14 and 28 days and compared with the hardness of comparable control photographic paper measured at the same intervals. The hardness test used was the multi-arm scribe test (MAST). The MAST apparatus allows stylii to be moved across the surface of the coating at a fixed velocity but under continuously increasing loads. The test involves swelling the coating in the appropriate developer solution at a temperature of 32±3C. for a period of 30 seconds and then measuring the average load at which 0.008 and 0.012 inch diameter stylii continuously penetrate and visually deform the surface of the coating as they move along it. The load is reported in grams.

The complete results from the (28 day) testing are shown in FIG. 1. It can be readily seen that the control samples show a steady increase as judged by the first 4 data points (2, 3, 7, 14 days) and then "plateauing out" in the period 14–28 days. On the other hand, the test rolls are already showing a higher MAST level at 2 days (30 vs 21). Moreover, the test rolls maintain this higher level for the duration of the trial (30.5 to 39.0).

The test rolls at 2 days and the control rolls at 7 days show similar MAST values. At 3 days, the test rolls show a higher MAST value than the highest value achieved over the entire period by the control rolls.

Figure 2:
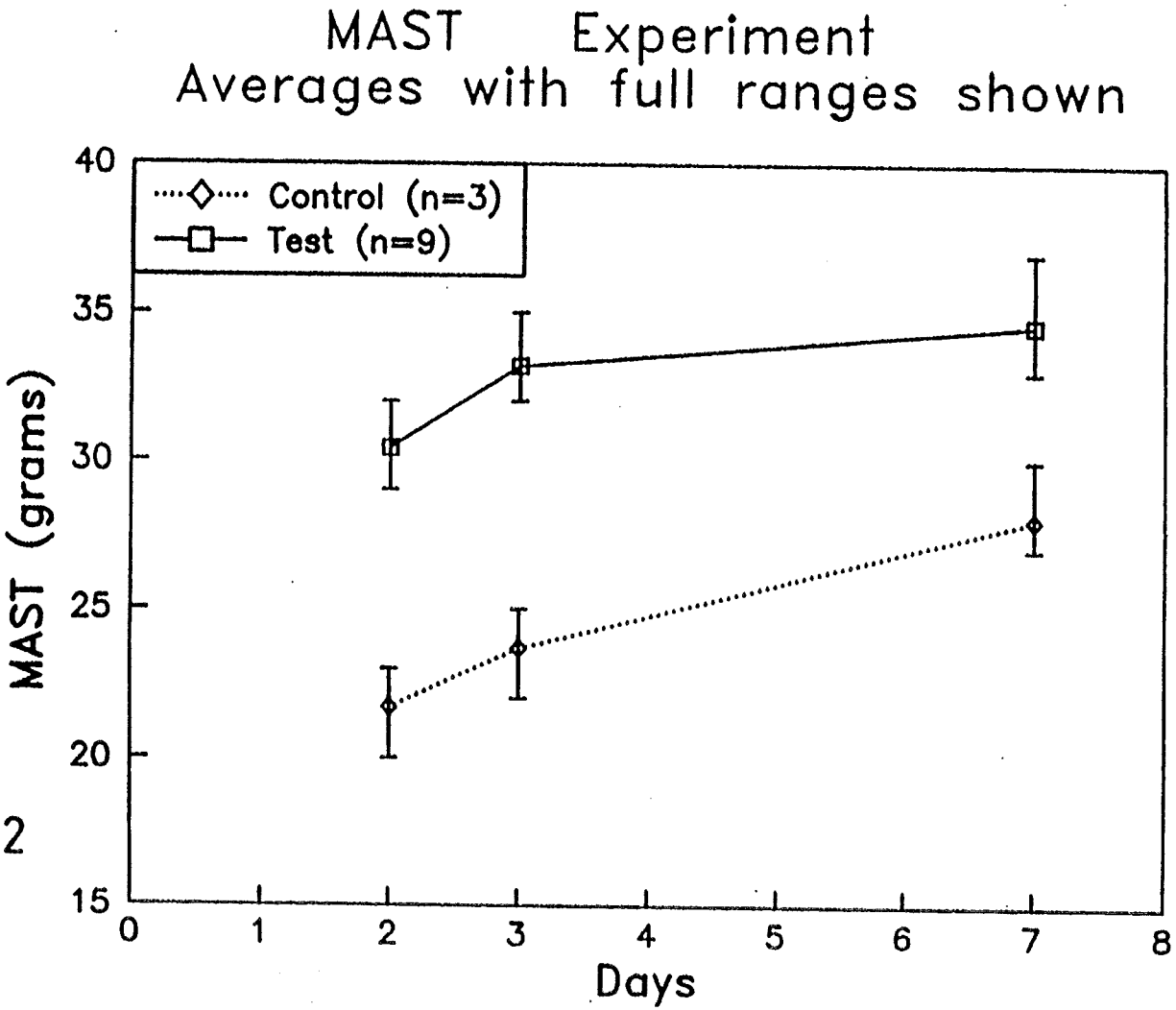

For the purposes of assessing variability, the ranges of data over the first 7 days, where there are 9 data points for the test rolls and 3 for the control rolls at each measurement day, are shown in FIG. 2. If there were to be differences in variability between test and control samples, these differences would be apparent over the first seven days. However, there is no significant difference in variability level between test and control samples at any of the days studied i.e. both control and test standard deviations approximate the test capability.

Various sensitometric tests were performed on the test and control samples to determine photographic response, and these tests revealed that sensitometric performance of the test samples was in all cases excellent and comparable to the control samples.

It is to be understood that various alterations, modifications and/or additions may be introduced into the parts and methods previously described without departing from the ambit of the invention.

We claim:

1. A photographic paper production method comprising the steps of:

(a) coating a photographic paper support, the support having a first equilibrium relative humidity (ERH), with one or more photographic silver halide emulsion layers and one or more other hydrophilic colloid layers, at least one of said layers including a hardener;

(b) drying the coated photographic paper support;

(c) conditioning the coated photographic paper support to a temperature of from 24° C. to 33° C. and conditioning the photographic and other layers on the photographic paper support to a second equilibrium relative humidity (ERH) of from 55% to 70%, the second ERH having a higher value than the first ERH, to provide favorable conditions for hardening of said layers; and (d) storing the coated photographic paper support substantially at the conditioned temperature and allowing a humidity redistribution between the photographic and other layers and the photographic paper support, until the photographic and other layers have achieved a MAST hardness of 25 grams or more.

2. A photographic paper production method according to claim 1 wherein the coated photographic paper support is placed within a moisture proof casing or material prior to the storing step.

3. A photographic paper production method according to claim 1 wherein the water content of the photographic paper support prior to the coating step is between 7 and 8 weight per cent.

4. A photographic paper production method according to claim 3 wherein the water content of the photographic paper support is between 7.5 and 8 weight per cent.

5. A photographic paper production method according to claim 1 wherein the photographic paper support is pre-coated with a polyethylene resin before the coating step, to retard redistribution of humidity between the photographic paper support and said layers to maintain said favorable conditions during said storing.

6. A photographic paper production method according to claim 1 wherein the conditioning temperature is approximately 26° C.

7. A photographic paper production method according to claim 1 wherein the conditioned, second ERH is approximately 63%.

8. A photographic paper production method according to claim 1 wherein the step of storing the coated photographic paper support at the conditioned temperature has a duration of less than 14 days.

9. A photographic paper production method according to claim 8 wherein the step of storing has a duration of less than 7 days.

10. A photographic paper production method according to claim 8 wherein the step of storing has a duration of 2 days or less.

11. A photographic paper production method according to claim 1 wherein the step of storing substantially at the conditioned temperature continues until the photographic and other layers have achieved a MAST hardness of 30 grams or more.

12. A photographic paper production method according to claim 1 wherein the first equilibrium relative humidity (ERH) of the photographic paper support prior to the coating step is approximately 53%.

* * * * *